US006280243B1

(12) United States Patent
Liu et al.

(10) Patent No.: US 6,280,243 B1
(45) Date of Patent: Aug. 28, 2001

(54) CABLE CONNECTOR ASSEMBLY

(75) Inventors: Ricky Liu; Lucio Costa, both of Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/528,072

(22) Filed: Mar. 17, 2000

(30) Foreign Application Priority Data

Feb. 2, 2000 (TW) ..... 089101765

(51) Int. Cl.[7] ..... H01R 11/00
(52) U.S. Cl. ..... 439/502; 439/638
(58) Field of Search ..... 439/502, 505, 439/638, 623

(56) References Cited

U.S. PATENT DOCUMENTS 5,518,418 * 5/1996 Larabell ..... 439/505
5,954,538 * 9/1999 Huang ..... 439/502
5,971,799 * 10/1999 Swade ..... 439/502
6,007,372 * 12/1999 Wood ..... 439/502
6,106,328 * 8/2000 O'Neal ..... 439/623

* cited by examiner

*Primary Examiner*—Gary F. Paumen
(74) *Attorney, Agent, or Firm*—Wei Te Chung

(57) ABSTRACT

A cable connector assembly comprises two plugs, a collected plug and two cables extending from each plug to the collected plug. Each plug includes a first contact unit and a second contact unit, a joint connecting the first and the second contact units, and a jacket covering the first and the second contact units. Each cable has a first end extending through an aperture of a fixing portion of the jacket and into a position between the first and the second contact units of a corresponding plug and is fixed to the plug by the fixing portion of the jacket. The collected plug connects with second ends of the cables and also connects to a network. A method for manufacturing the cable connector assembly comprises the steps of: (A) preparing the first and the second contact units and cables; (B) a soldering step; (C) forming the joints; (D) forming the jackets; (E) forming the jacket of the collected plug.

3 Claims, 7 Drawing Sheets

CABLE CONNECTOR ASSEMBLY

BACKGROUND OF THE INVENTION

1. Field of the Invention

The present invention relates to a cable connector assembly, and particularly to a cable connector assembly for transmission of signals among a keyboard/mouse, a keyboard/mouse interface in a host computer, and an interface of a network server, and a method for manufacturing the cable connector assembly.

2. Description of Prior Art

A conventional cable connector assembly used in the computer industry is shown in FIG. 9. The cable connector assembly comprises four single plugs 5, a collected plug 6 to be connected to a network server, and four cables 7*a*, 7*b*, 7*c* and 7*d* each having a plurality of wires therein and extending from a rear end of each single plug 5 to the collected plug 6. The single plugs 5 include a female MINI DIN type plug 51*a* to be connected to a keyboard, a male MINI DIN type plug 51*b* to be connected to a keyboard interface in a host computer, a female MINI DIN type plug 52*a* to be connected to a mouse, and a male MINI DIN type plug 52*b* to be connected to a mouse interface in the host computer. To transmit signals among the keyboard, the mouse, the keyboard and mouse interfaces in the host computer, and the network server, the prior art cable connector assembly needs nine components, i.e., four single plugs 5, four cables 7 and a collected plugs 6, which requires a complicated and high cost inventory. Furthermore, for transmitting signals between the female MINI DIN plugs 51*a*, 52*a* and corresponding male MINI DIN plugs 51*b*, 52*b*, the wires of the cables 7*a* and 7*b* respectively need to be electrically connected to the wires of the cable 7*c* and 7*d* within the collected plug 6, thus causing the manufacture of the assembly to be complicated. Hence, an improved electrical connector is required to overcome the disadvantages of the prior art.

SUMMARY OF THE INVENTION

A first object of the present invention is to provide a cable connector assembly which has plugs with female and male contact units which are fixed together and can easily transmit signals therebetween.

A second object of the present invention is to provide a cable connector assembly which has a reduced number of components thereby decreasing manufacturing cost and space requirements.

A further object of the present invention is to provide a method for manufacturing the cable connector assembly.

A cable connector assembly in accordance with the present invention comprises two plugs, a collected plug and two cables each extending from a different plug to the collected plug. To perform a function similar to that of the prior art, the present invention needs only five components thus the manufacturing cost is decreased. Each plug includes a first contact unit and a second contact unit, a joint connecting the first and second contact units, and a jacket covering the first and second contact units. A first end of each cable extends into the corresponding plug at a position between the first and second contact units and is fixed by a fixing portion integrally formed with the jacket. The first end of each cable extends through an aperture of the fixing portion at a specified angle. The collected plug connects with second ends of the cables and is connected to an interface of a network server. A method for manufacturing the cable connector assembly comprises the steps of: (A) preparing the first and second contact units; (B) a soldering step; (C) forming the joint; (D) forming the jacket; (E) forming the jacket of the collected plug.

Other objects, advantages and novel features of the invention will become more apparent from the following detailed description of the present embodiment when taken in conjunction with the accompanying drawings.

DETAILED DESCRIPTION OF THE INVENTION

Figure 1:
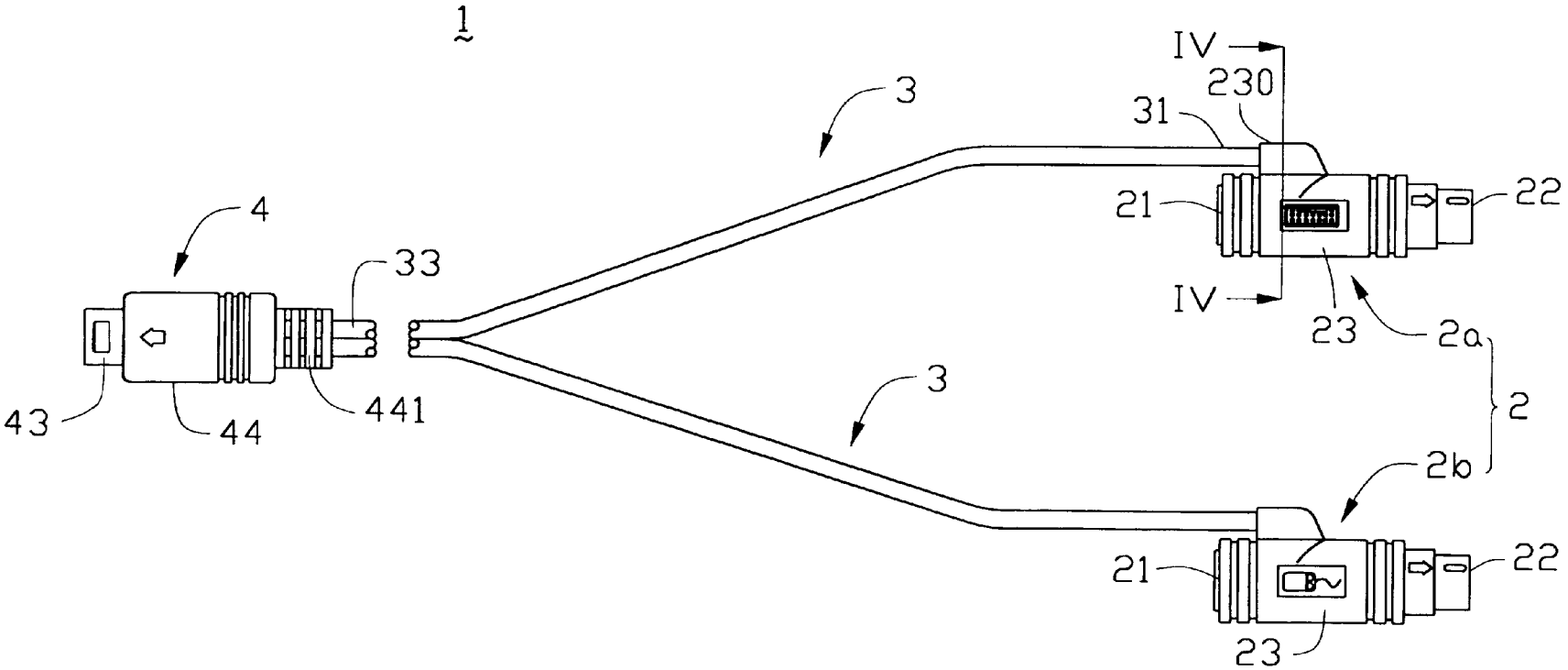
FIG. 1 is an assembled view of a cable connector assembly in accordance with a first embodiment of the present invention.

Referring to FIG. 1, a cable connector assembly 1 in accordance with a first embodiment of the present invention comprises two plugs 2, a collected plug 4 and two cables 3 respectively extending from the plugs 2 to the collected plug 4.

The two plugs 2 include a first plug 2*a* relating to keyboard connection and a second plug 2*b* relating to mouse connection. Also referring to FIG. 4 each plug 2 comprises a first contact unit 21, a second contact unit 22, a joint 24 connecting the first and second contact units, and a jacket 23 (FIG. 1) covering the first and second contact units. Each first contact unit 21 is a female MINI DIN type connector for electrically connecting to a corresponding keyboard or mouse. Each second contact unit 22 is a male MINI DIN type connector for electrically connecting to a corresponding keyboard or mouse interface in a host computer. The jacket 23 integrally forms a fixing portion 230 having a circular aperture 2301 (FIG. 5) extending parallel to an axial line of the plug 2.

Figure 2:
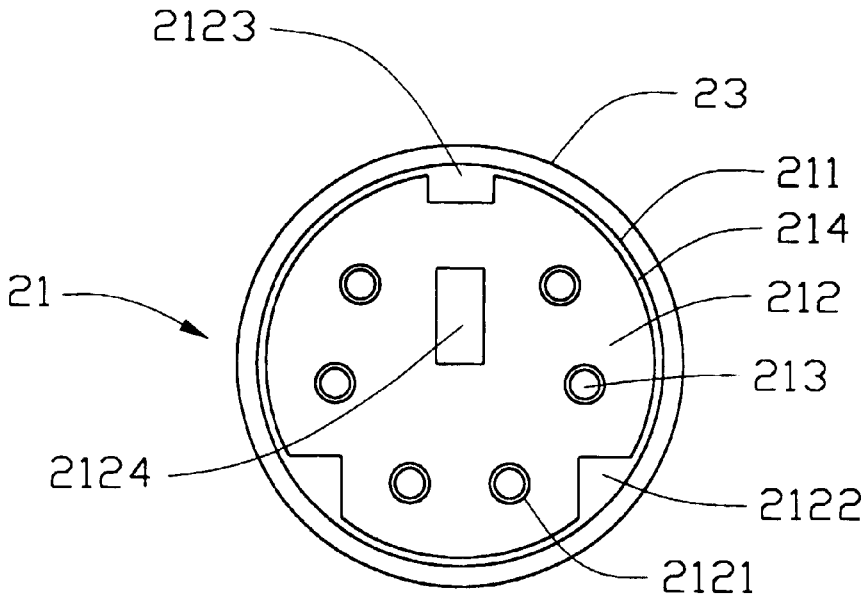
FIG. 2 is an end view of a first contact unit of a plug of the cable connector assembly of FIG. 1.
Figure 4:
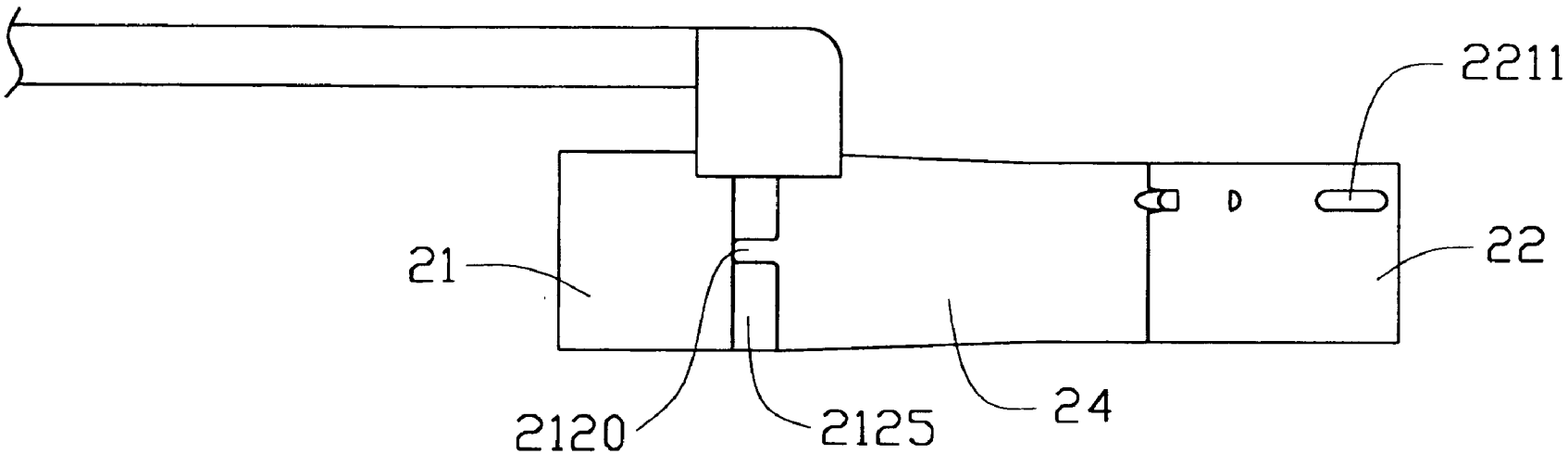
FIG. 4 is a semi-assembled view of the plug wherein a jacket is removed and the first contact unit and the second contact unit are connected by a joint.

Referring to FIGS. 2 and 4, each first contact unit 21 comprises a cylindrical annular shell 211 and a cylindrical insulative housing 212 having a plurality of housing protrusions 2125 protruding beyond a posterior portion of the shell 211 and secured thereto, and a plurality of contacts 213. An annular groove 214 is defined between the shell 211 and the housing 212 into which a shielding of a mating connector (not shown) extends when the first contact unit is connected with the mating connector. The housing 212 defines a plurality of contact receiving slots 2121 for receiving the contacts 213 and terminals of the mating connector to electrically connect with the contacts 213. The housing 212 defines two quarter-circle recesses 2122 and a generally rectangular recess 2123 in a circumference thereof and a rectangular depression 2124 generally at a central portion thereof for polarization purposes.

Figure 3:
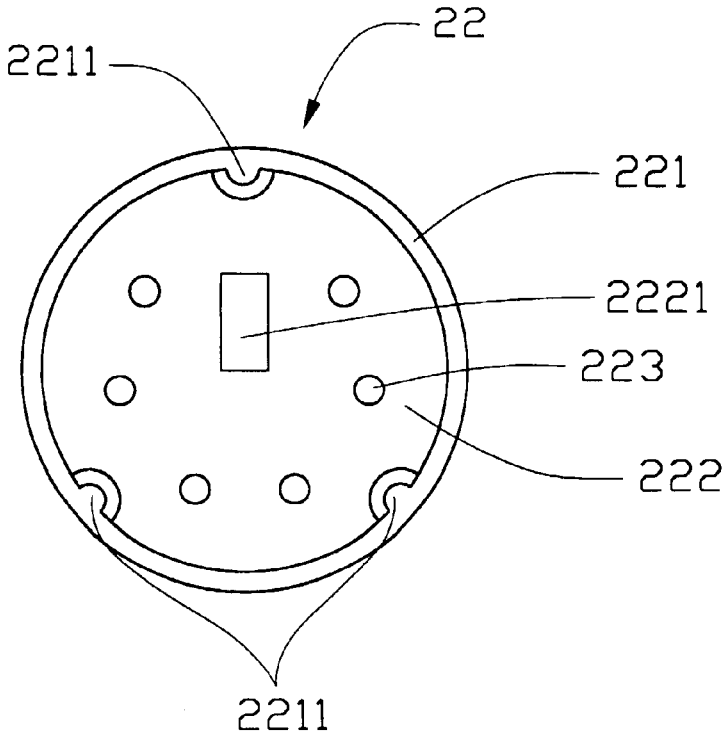
FIG. 3 is an end view of a second contact unit of the plug of the cable connector assembly of FIG. 1.

Referring to FIG. 3, each second contact unit 22 comprises a cylindrical annular shell 221, a cylindrical housing 222 and a plurality of contacts 223 projecting from the housing 222. The shell 221 forms three indents 2211 slightly projecting toward a center of the unit 22 and the housing 222 forms a rectangular guiding protrusion 2221. The indents 2211 and the guiding protrusion 2221 ensure correct engagement between the second contact unit 22 and a mating connector (not shown).

Figure 5:
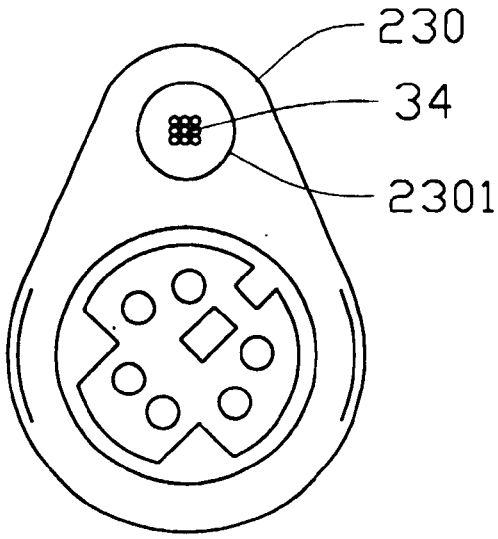
FIG. 5 is a sectional view taken along IV—IV in FIG. 1.
Figure 6:
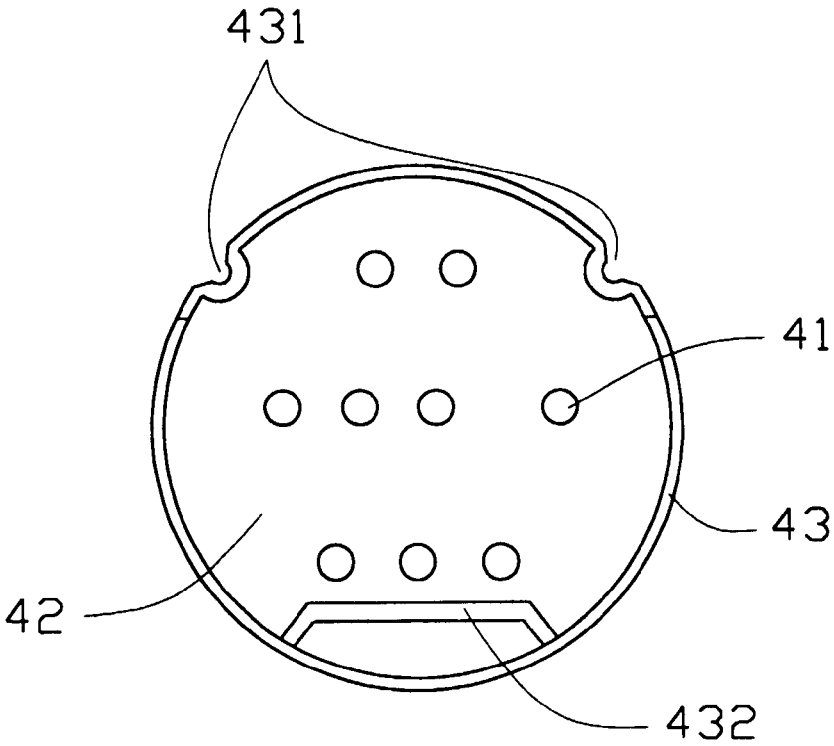
FIG. 6 is an end view of a collected plug of the cable connector assembly of FIG. 1.

Referring to FIGS. 1 and 5, the two cables 3 each have a plurality of wires 34 therein for connecting with corresponding contacts 213, 223 of the plugs 2 and contacts 41 of the collected plug 4 (FIG.6). Each cable 3 has a first end 31 connecting with a corresponding plug 2 at a position between the first and second contact units 21, 22. Each cable 3 further has a second end 33 connecting to a rear part of the collected plug 4. The first end 31 is fixed by the fixing portion 230 of the jacket 23 and extends through the aperture 2301 of the fixing portion 230.

Referring to FIGS. 1 and 6, the collected plug 4 connects with the two cables 3 at a rear end thereof and connects to an interface of a network server (not shown). The collected plug 4 includes a plurality of contacts 41 received within passageways defined through a cylindrical insulative housing 42, a cylindrical annular shell 43 surrounding the housing 42, and a jacket 44 covering the shell 43. The contacts 41 project out of the housing 42 for connecting with terminals of a mating connector. The shell 43 inwardly forms two small indents 431 and a large indent 432 for polarization purposes. The jacket 44 forms a fixing portion 441 for preventing the second ends 33 of the cables 3 from disconnecting from the contacts 41 due to a pulling force acting on the cables 3.

Figure 7:
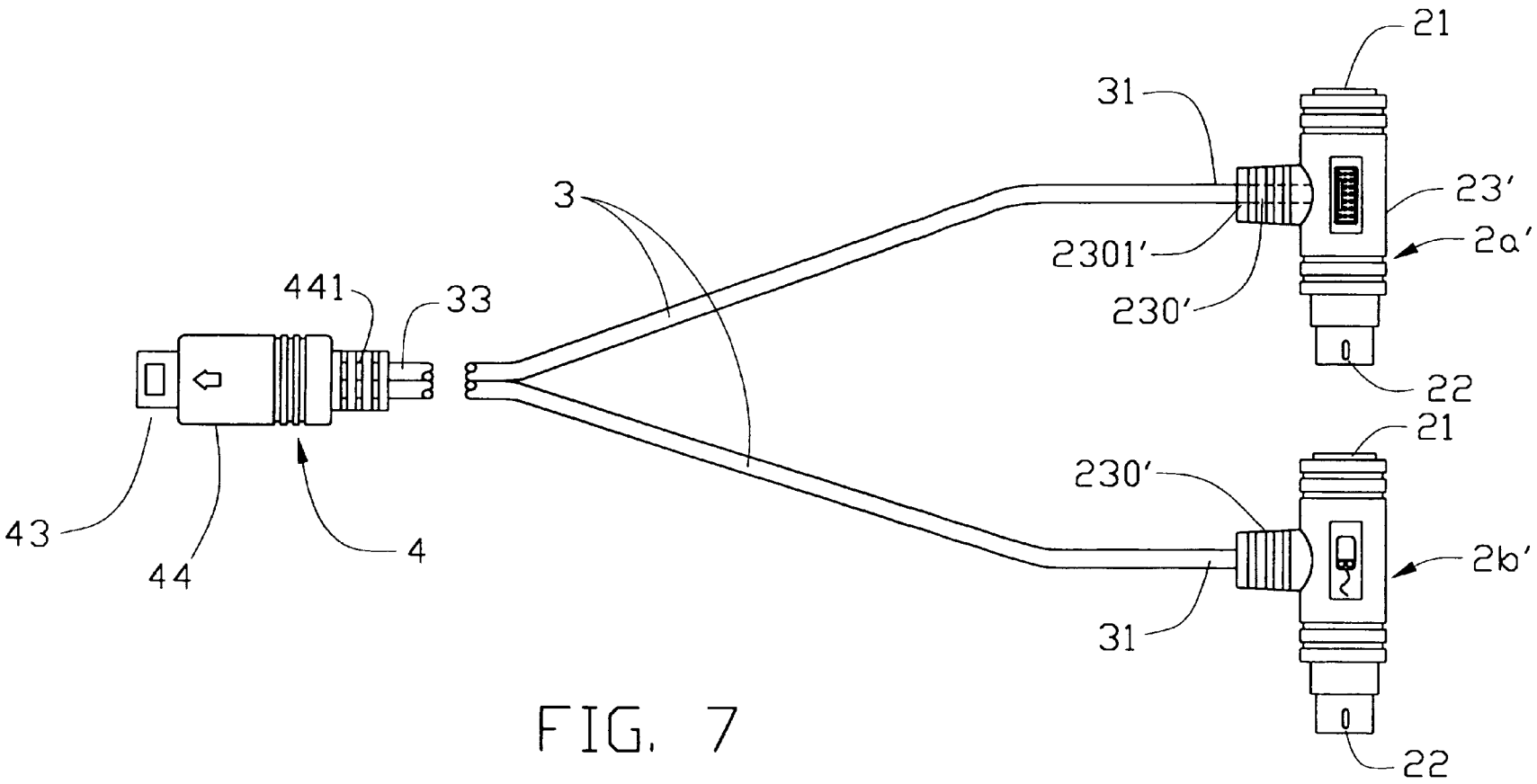
FIG. 7 is an assembled view of a cable connector assembly in accordance with a second embodiment of the present invention.

FIG. 7 shows a second embodiment of the present invention. The second embodiment is substantially the same as the first embodiment except that the second embodiment has fixing portions 230' with apertures 2301' which are perpendicular to axial lines of the plugs 2*a*', 2*b*', respectively, wherein the cables 3 extend through the apertures 2301' into the plugs 2*a*', 2*b*'.

The process for manufacturing the cable connector assembly in accordance with the first embodiment of the present invention mainly comprises the following steps. The second embodiment is manufactured in a manner substantially the same as the first embodiment.

(A) preparing the first and second contact units and cables;

(B) a soldering step;

(C) forming the joint;

(D) forming the jackets; and (E) forming the jacket for the collected plug.

In step (A), the first and second contact units 21, 22 of the plugs 2 (see FIG. 8), and a contact portion (not labeled) of the collected plug 4 comprising the contacts 41, the housing 42 and the shell 43, and the cables 3 are respectively prepared.

In step (B) some of the contacts 213, 223 of the first and second contact units 21, 22 are electrically connected by soldering short wires 32 therebetween thus establishing a direct electrical connection between the first and second units 21, 22 which shortens the signal transmission path therebetween. The remaining unconnected contacts 213 and 223 are soldered to the corresponding wires 34 of the cable 3. The contacts 41 are also soldered to the corresponding wires 34 of the cables 3.

Figure 8:
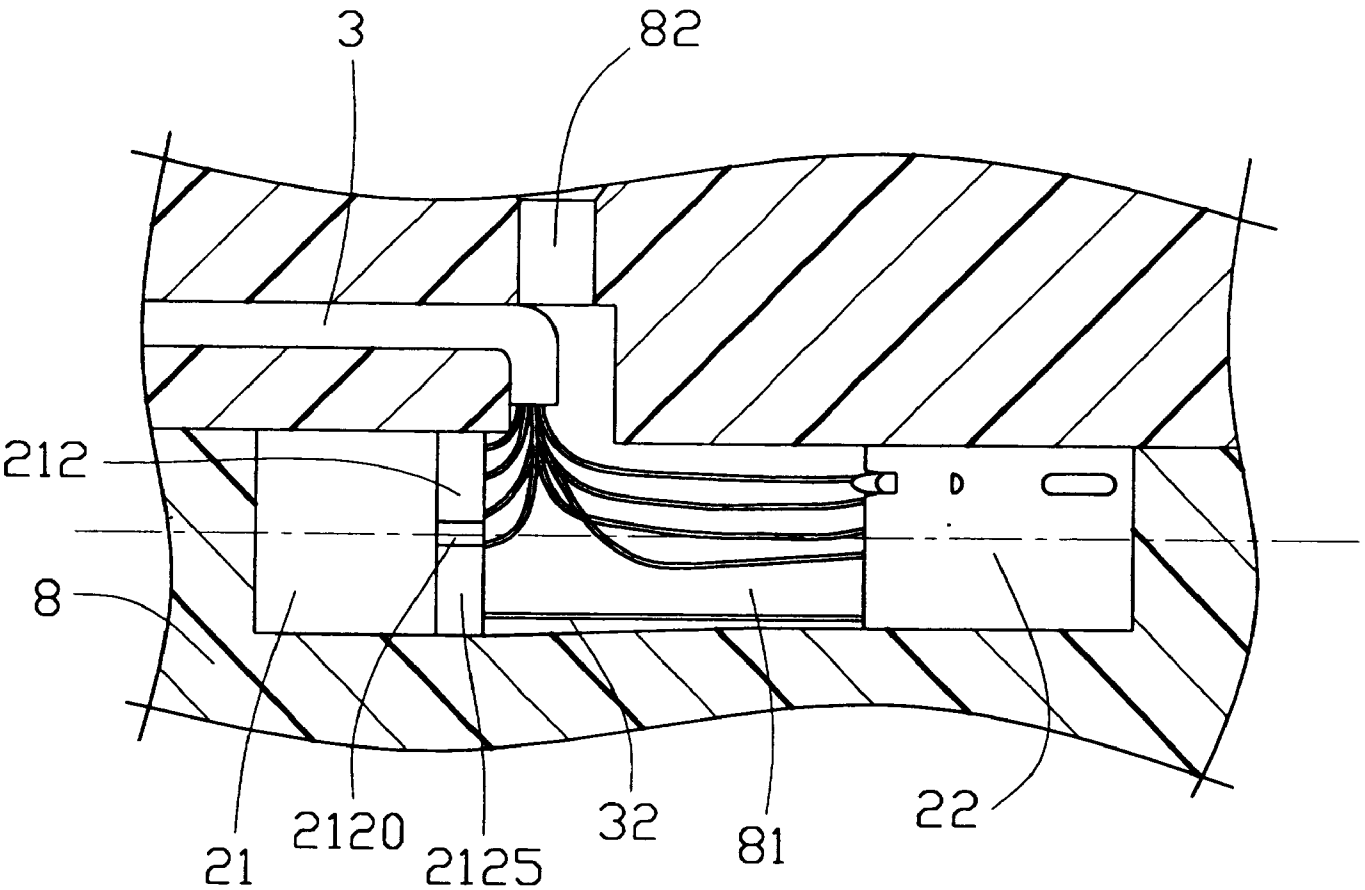
FIG. 8 is a view of a first and second contact units of the plug of FIG. 1, wherein the mold is drawn in section, disposed in a mold for forming the joint.
Figure 9:
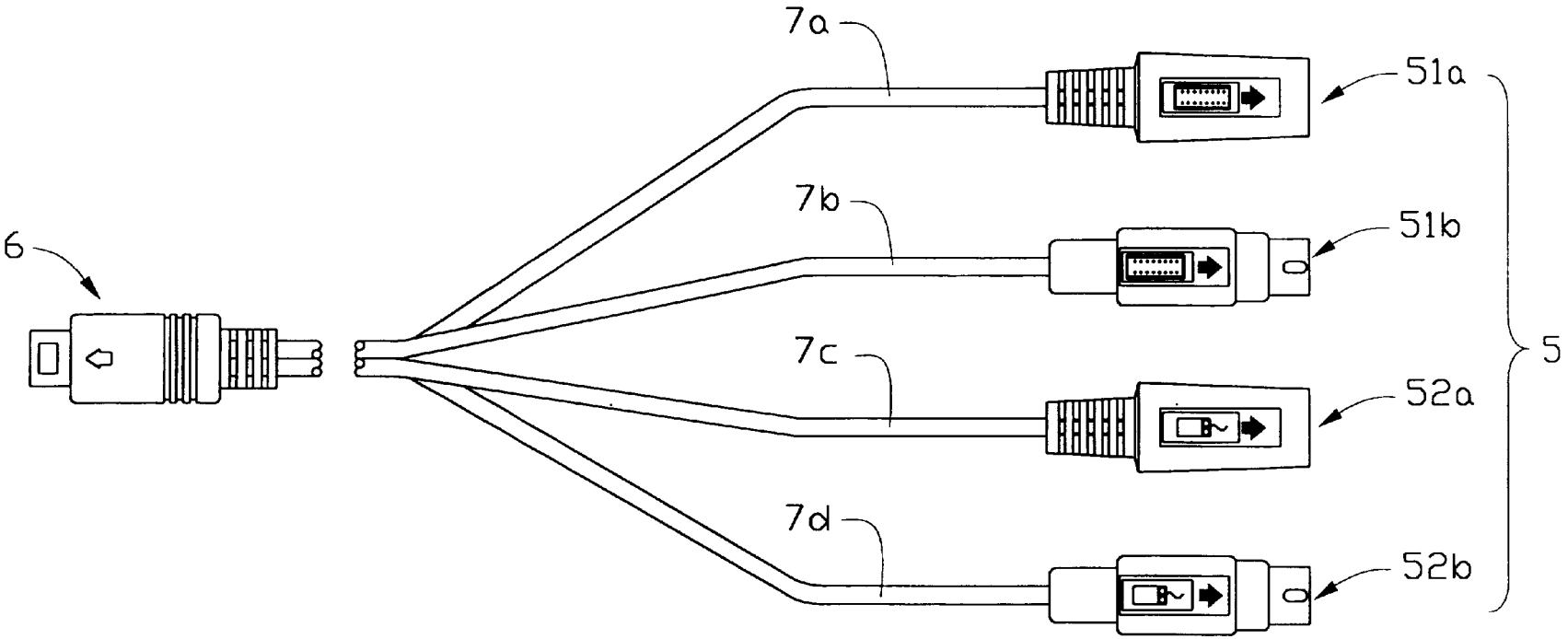
FIG. 9 (PRIOR ART)
FIG. 9 is an assembled view of a prior art cable connector assembly.

In step (C) the joints 24 are formed by using an insert-molding process. In the insert-molding process, the first and second contact units 21, 22 are respectively placed in two end portions of a cavity 81 of a mold 8, as shown in FIG. 8, with their axial lines being in alignment with each other, and the cable 3 is extended into the cavity 81 between the first and second contact unit 21, 22 at a predetermined angle. Molding material is injected into the cavity 81 from an inlet 82 to form the joint 24 which extends into several recesses 2120 between the housing protrusions 2125 of the housing 212 and an inner part of a rear portion of the second contact unit 22 thereby securing the first and the second contact units 21, 22 together to obtain a subassembly of the plug 2 as shown in FIG. 4. The whole wires 34 connecting the contacts 213, 223 of the first and second contact units 21, 22 and the short wires 32 are embedded and protected within the joint 24 for preventing the wires from disconnecting from the contacts 213, 223 due to a pulling force acting on the cable 3.

In step (D), the jackets 23 are formed by subjecting the subassembly of FIG. 4 to a further insert-molding process, which covers the subassembly obtained in step (C) to form a complete plug 2. The jacket 23 forms the fixing portion 230 having the aperture 2301 parallel to the axial line of the plug 2. The cable 3 extends through the aperture 2301. As the process of molding and forming the jacket 23 are well known to persons skilled in the art, detailed drawings and descriptions thereof are omitted here.

In step (E), the jacket 44 of the collected plug 4 is formed using an insert-molding process. The jacket 44 covers the contact portion (not labeled) and integrally forms the fixing portion 441 securely engaging with the second end 33 of the cables thereby preventing a pulling force on the cables 3 from adversely affecting the connection between the cables 3 and the contacts 41.

In manufacturing the plugs 2, the joint 24 and the jackets 23 of the plugs 2 are formed by insert molding thereby promoting production efficiency.

Since the plug 2 includes the first and second contact units 21, 22, one plug 2 can perform two functions, ie., it can simultaneously electrically connect to two different devices, and connections between the first and second contact units 21,22 are shorten. This design decreases the manufacturing cost and the space required by the cable connector assembly as compared to the prior art. Moreover, in comparison with the second embodiment, in the first embodiment the cable 3 defines a first end over-molded with the middle portion of the plug 2, and extends from such middle portion parallel to the axial direction of the plug 2 toward and beyond the first contact unit 21, so as to leave the relatively greater space around the opposite second contact unit 22 and allow the two second contact units of the two plugs 2 to be easily connected to the corresponding two close outlets on the back panel of the computer without interference.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a plurality of plugs each including a first contact unit for mating with a first connector, a second contact unit directed opposite to the first contact unit for mating with a second connector, a joint connecting the first and second contact units at a first and second sides of the joint, respectively, and a jacket covering the first and second contact units and the joint;

a plurality of cables, each including a first end and a second end, the first end extending into a corresponding plug through a corresponding jacket at a position between the first and the second contact units and electrically connecting therewith; and a collected plug connecting with the second ends of the cables for mating with a third connector;

wherein the jacket integrally forms a fixing portion having an aperture extending at a predetermined angle relative to an axial line of the plug, and the first end of the cable extends through the aperture and into the plug;

wherein the first end of the cable is fixed by the fixing portion;

wherein the first contact unit is a female MINI DIN type connector for connecting with a keyboard/mouse, and the second contact unit is a male MINI DIN connector for connecting with a keyboard/mouse interface of a host computer;

wherein the first contact unit and the second contact unit can transmit signals between each other via a plurality of short wires electrically connecting the two units;

wherein the first contact unit comprises a cylindrical annular shell and a cylindrical insulative housing having a plurality of housing protrusions protruding beyond a posterior portion of the shell and secured thereto;

wherein the joint of the plug extends into recesses between the protrusions of the insulative housing and into an inner part of a rear portion of the second contact unit thereby securing the first and second contact units together;

wherein the collected plug is a mate MIN DIN type connector for connecting with an interface of a network server.

2. The cable connector assembly as claimed in claim 1, wherein the aperture extends in a direction parallel to the axial line of the plug.

3. The cable connector assembly as claimed in claim 1, wherein the aperture extends in a direction vertical to the axial line of the plug.

* * * * *